US010066814B2

(12) United States Patent
Mostoller

(10) Patent No.: US 10,066,814 B2
(45) Date of Patent: Sep. 4, 2018

(54) SOLID STATE LIGHTING ASSEMBLY

(75) Inventor: Matthew Edward Mostoller, Hummelstown, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 317 days.

(21) Appl. No.: 13/347,751

(22) Filed: Jan. 11, 2012

(65) Prior Publication Data

US 2013/0176708 A1 Jul. 11, 2013

(51) Int. Cl.

| | |
|---|---|
| ***F21V 29/00*** | (2015.01) |
| ***F21V 33/00*** | (2006.01) |
| ***F21V 19/00*** | (2006.01) |
| ***F21V 23/00*** | (2015.01) |
| *H01R 12/72* | (2011.01) |
| *H01R 12/75* | (2011.01) |
| *F21V 29/70* | (2015.01) |
| *F21Y 115/10* | (2016.01) |

(52) U.S. Cl.

CPC ..... *F21V 19/0055* (2013.01); *F21V 23/006* (2013.01); *F21V 29/70* (2015.01); *F21Y 2115/10* (2016.08); *H01R 12/721* (2013.01); *H01R 12/75* (2013.01)

(58) Field of Classification Search

CPC ..... F21V 19/003; F21V 23/06; H01R 12/721; H01R 12/75; H01R 31/06

See application file for complete search history.

(56) References Cited

U.S. PATENT DOCUMENTS

| | | | | |
|---|---|---|---|---|
| 8,342,733 | B2 | 1/2013 | Daily et al. | |
| 2009/0207617 | A1* | 8/2009 | Merchant et al. | 362/294 |
| 2009/0218923 | A1* | 9/2009 | Gingrich et al. | 313/1 |
| 2010/0026158 | A1* | 2/2010 | Wu | 313/46 |
| 2011/0058387 | A1* | 3/2011 | Matsunaga et al. | 362/547 |

FOREIGN PATENT DOCUMENTS

| | | | |
|---|---|---|---|
| EP | 2 333 407 | A1 | 6/2011 |
| EP | 2665130 | A1 | 11/2013 |
| JP | 2011 060458 | A | 3/2011 |
| JP | 2011 124577 | A | 6/2011 |

OTHER PUBLICATIONS

International Search Report, International Application No. PCT/US2013/020025/International Filing Date Mar. 1, 2013.

* cited by examiner

*Primary Examiner* — Nimeshkumar Patel
*Assistant Examiner* — Jacob R Stern

(57) ABSTRACT

A solid state lighting assembly includes a heat sink and a socket assembly coupled to the heat sink. The socket assembly includes a socket housing having an interior surface mounted to a front of the heat sink and having an extension extending from the interior surface. The extension is received in an opening of the heat sink and extends at least partially through the heat sink. A socket contact is held by the socket housing and includes a package mating end and a power termination end. The power termination end extends into a cavity of the extension such that the power termination end extends at least partially through the heat sink. The power termination end is terminated to a power conductor and the package mating end is mechanically and electrically coupled to a solid state lighting package to supply power thereto.

17 Claims, 5 Drawing Sheets

SOLID STATE LIGHTING ASSEMBLY

BACKGROUND OF THE INVENTION

The subject matter herein relates generally to solid state lighting assemblies.

Solid-state light lighting systems use solid state light sources, such as light emitting diodes (LEDs), and are being used to replace other lighting systems that use other types of light sources, such as incandescent or fluorescent lamps. The solid-state light sources offer advantages over the lamps, such as rapid turn-on, rapid cycling (on-off-on) times, long useful life span, low power consumption, narrow emitted light bandwidths that eliminate the need for color filters to provide desired colors, and so on.

LED lighting systems typically include LEDs soldered down to a printed circuit board (PCB). The PCB then is mechanically attached to a heat sink of the lighting fixture. The PCB is then electrically connected to a LED driver or other power source, such as by soldering wires between the PCB and the LED driver. Some known LED lighting systems, such as chip-on-board LED systems, use sockets to provide the mechanical connection to the heat sink and the electrical connection to the PCB. For example, wires are routed from the LED driver to contacts held in the socket. The wires are typically routed around or through the heat sink to the socket side of the heat sink where the wires are terminated to the contacts. These systems are not without disadvantages. For instance, routing of the wires through the heat sink and termination of the wires to the contacts is a manual process which can be time consuming and labor intensive. Additionally, routing of the wires uses valuable real estate of the heat sink. Additionally, problems arise when the LEDs or the PCB needs to be replaced in the future. The rework process is tedious and may require a skilled person to perform the removal and replacement.

A need remains for a lighting system that may be efficiently packaged into a lighting fixture. A need remains for a lighting system that may be efficiently configured for an end use application.

BRIEF DESCRIPTION OF THE INVENTION

In one embodiment, a solid state lighting assembly is provided including a heat sink having a front and a rear and having an opening therethrough between the front and the rear. A socket assembly is coupled to the heat sink. The socket assembly includes a socket housing having an interior surface mounted to the front of the heat sink and having an extension extending from the interior surface. The extension is received in the opening and extends at least partially through the heat sink. The extension has a cavity therein. A socket contact is held by the socket housing. The socket contact has a package mating end and a power termination end. The power termination end extends into the cavity of the extension such that the power termination end extends at least partially through the heat sink. The power termination end is configured to be terminated to a power conductor. The package mating end is configured to be mechanically and electrically coupled to a solid state lighting package to supply power to a solid state lighting device of the solid state lighting package.

Optionally, the extension may extend entirely through the heat sink such that a portion of the extension extends beyond the rear of the heat sink. The extension may extend generally perpendicular with respect to the interior surface along a cavity axis and the power termination end may extend within the cavity generally along the cavity axis. The cavity may receive the power conductor in a mating direction along the cavity axis. The socket contact may be mated to the power conductor along a mating direction generally perpendicular to the interior surface.

Optionally, the package mating end and the power termination end may be oriented generally perpendicular with respect to one another. The socket housing may press the solid state lighting package against the front of the heat sink in a pressing direction. The power termination end may extend generally parallel to the pressing direction. The cavity may be cylindrical in shape to receive the power conductor. The power conductor may be an end of a wire or may be a pin. Optionally, the cavity may define a card edge slot configured to receive an edge of a driver board. The driver board may have a power pad defining the power conductor. The power termination end may mechanically and electrically engage the power pad on the driver board. The power termination end may define a poke-in wire termination having a deflectable beam engaging an end of a wire poked into the cavity. The power termination end may define a crimped termination engaging an end of a wire.

In another embodiment, a solid state lighting assembly is provided including a socket housing having an interior surface and an exterior surface. The socket housing has an opening therethrough between the interior surface and the exterior surface. The interior surface is configured to be mounted to a heat sink. The socket housing has a receptacle open at the interior surface. A solid state lighting package is received in the receptacle. The solid state lighting package has a lighting device aligned with the opening and configured to emit light. The solid state lighting package has a power pad configured to supply power to the lighting device. A socket contact is held by the socket housing. The socket contact has a package mating end engaging the power pad of the solid state lighting package at a separable mating interface. The socket contact has a power termination end extending transverse to the package mating end. The power termination end is configured to be mated to a power conductor along a mating direction. The mating direction is generally perpendicular to the interior surface of the socket housing.

Optionally, the lighting assembly may include a heat sink having a front and a rear. The heat sink may have an opening therethrough between the front and the rear. The socket contact may extend at least partially through the opening of the heat sink. The socket housing may have an extension extending from the interior surface. The extension may be received in the opening and may extend at least partially through the heat sink. The extension may have a cavity therein. The socket contact may be received in the cavity such that the power termination end extends at least partially through the heat sink.

In another embodiment, a solid state lighting assembly is provided including a socket housing having an interior surface and an exterior surface. The socket housing has an opening therethrough between the interior surface and the exterior surface. The interior surface is configured to be mounted to a heat sink. The socket housing has a cavity defining a card edge slot configured to receive an edge of a driver board. A socket contact is held by the socket housing. The socket contact has a package mating end and a power termination end. The power termination end extends into the cavity. The power termination end is configured to engage power conductors on the driver board when the driver board is received in the cavity. The package mating end is configured to be mechanically and electrically coupled to a solid state lighting package to supply power to a solid state lighting device of the solid state lighting package.

DETAILED DESCRIPTION OF THE INVENTION

Figure 1:
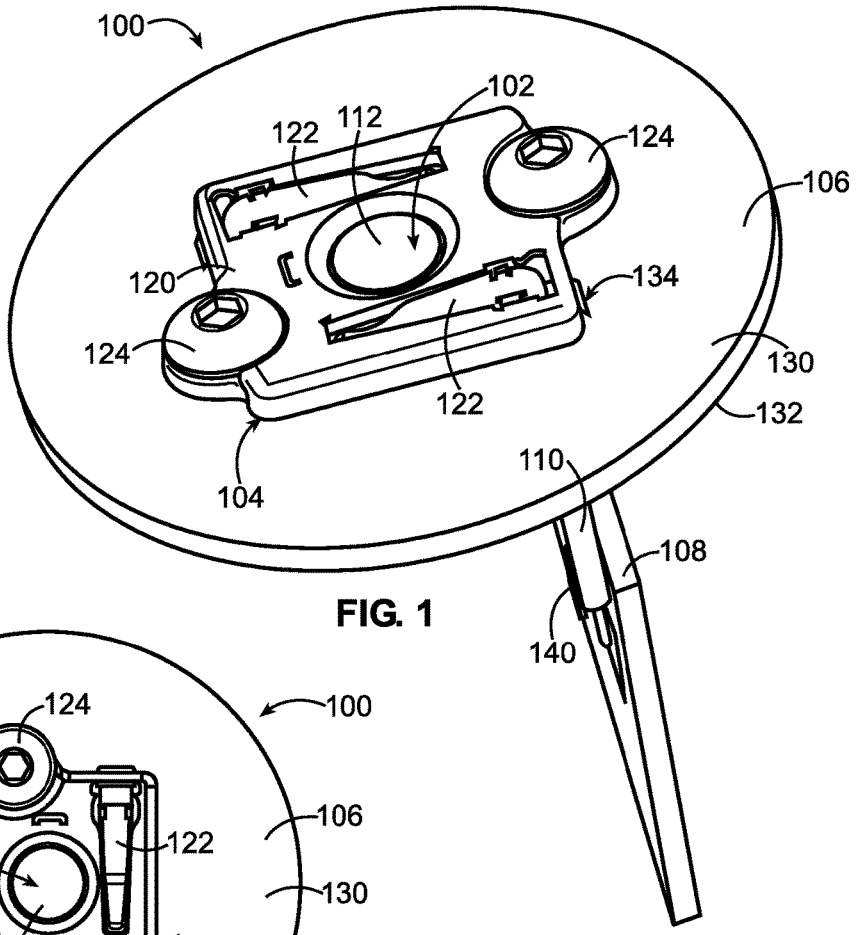
FIG. 1 is a top perspective view of a solid-state lighting assembly formed in accordance with an exemplary embodiment.
Figure 2:
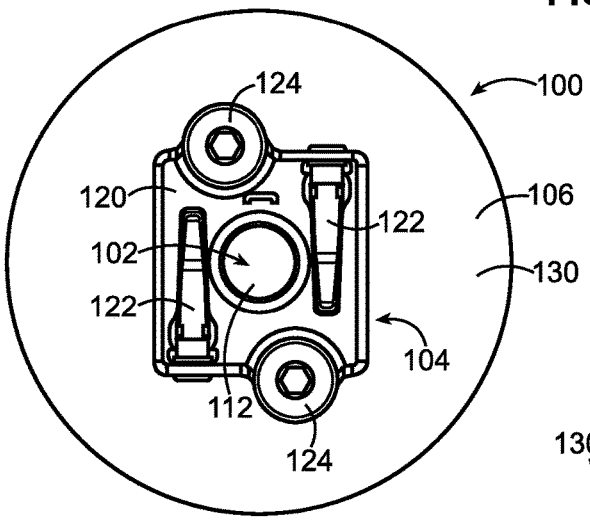
FIG. 2 is a top view of the solid-state lighting assembly shown in FIG. 1.
Figure 3:
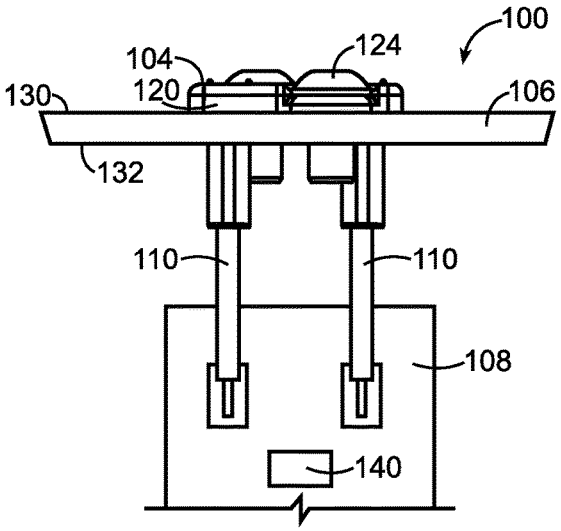
FIG. 3 is a side view of the solid-state lighting assembly shown in FIG. 1.

FIG. 1 is a top perspective view of a solid-state lighting assembly 100 formed in accordance with an exemplary embodiment. FIG. 2 is a top view of the solid-state lighting assembly 100. FIG. 3 is a side view of the solid-state lighting assembly 100. The lighting assembly 100 is part of a light engine that is used for residential, commercial or industrial use. The lighting assembly 100 can be used for general purpose lighting, or alternatively, may have a customized application or end use.

The lighting assembly 100 includes a solid-state lighting package 102 that is used to generate light. The lighting assembly 100 includes a socket assembly 104 used to hold and power the lighting package 102. The lighting assembly 100 includes a heat sink 106, or other mounting structure, supporting the socket assembly 104 and the lighting package 102. The heat sink 106 dissipates heat from the lighting package 102 to extend the useful life of the lighting package 102 and prevent damage to the lighting package 102.

The lighting assembly 100 includes a driver board 108 that is electrically connected to a power supply, such as a power supply to the fixture. The driver board 108 controls power to the lighting package 102. The driver board 108 is electrically connected to the lighting package 102 via power conductors 110 and the socket assembly 104.

The lighting package 102 includes a solid-state lighting device 112, such as a light emitting diode (LED). The lighting device 112 may be referred to hereafter as LED 112. Other types of solid-state lighting devices may be used in alternative embodiments. The lighting package 102 has a power interface for receiving power from the socket assembly 104 and a thermal interface that is in thermal communication with the heat sink 106.

The socket assembly 104 includes a socket housing 120 holding a pair of socket contacts 122. The socket contacts 122 engage the lighting package 102 at a separable interface to supply power to the lighting package 102. The socket contacts 122 are electrically coupled to the power conductors 110, which supply power to the socket contacts 122.

The socket assembly 104 includes fasteners 124 to secure the socket housing 120 to the heat sink 106. In an exemplary embodiment, the fasteners 124 are threaded fasteners, however other types of fasteners may be used in alternative embodiments. The fasteners 124 press the socket housing 120 against the heat sink 106, which in turn presses the lighting package 102 against the heat sink 106. For example, the lighting package 102 may be captured or sandwiched between the socket housing 120 and the heat sink 106. Tightening of the fasteners 124 presses the lighting package 102 against the heat sink 106. The socket contacts 122 also bias the lighting package 102 against the heat sink 106. The socket contacts 122 may absorb tolerances within the system.

The heat sink 106 may have any size or shape depending on the particular application. For example, the heat sink 106 may be generally circularly shaped for use in a can lighting fixture. In other embodiments, the heat sink 106 may be elongated, such as for use in a tube to replace a florescent bulb. The heat sink 106 has a front 130 and a rear 132 generally opposite the front 130. In an exemplary embodiment, one or more openings 134 (shown in FIG. 4) extend through the heat sink 106 between the front 130 and the rear 132. A portion of the socket assembly 104 extends through the opening 134. In an exemplary embodiment, the socket contacts 122 extend through the opening 134. The power conductors 110 may extend through the opening 134. The opening 134 are aligned with and generally contained within the perimeter of the socket assembly 104.

The driver board 108 includes electrical components 140 used to control power supplied to the lighting assembly 100. In an exemplary embodiment, the driver board 108 may be a printed circuit board. The driver board 108 includes power conductors, such as power pads. The power conductors 110 are electrically connected to the power pads on the driver board 108. In the illustrated embodiment, the power conductors 110 are wires extending from the driver board 108. The wires may be terminated to the driver board 108 by any known method, such as soldering or by terminating the wires to contacts, such as by using insulation displacement terminations, poke-in terminations, crimped terminations, and the like.

Figure 4:
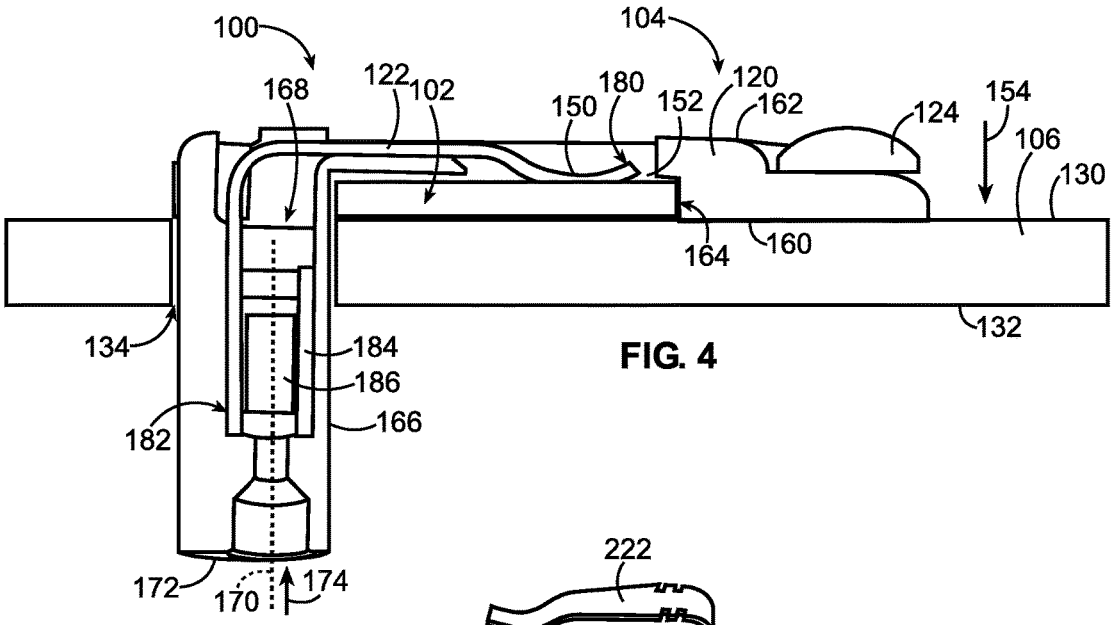
FIG. 4 is a cross sectional view of the lighting assembly shown in FIG. 1.

FIG. 4 is a cross sectional view of the lighting assembly 100. The socket assembly 104 is coupled to the heat sink 106. FIG. 4 illustrates the lighting package 102 in thermal communication with the heat sink 106 and held in place by the socket assembly 104. The lighting package 102 includes a power pad 150 on a surface of the lighting package 102 that is configured to supply power to the lighting device 112 (shown in FIG. 1). The power pad 150 is engaged by the socket contact 122 at a separable mating interface 152. The socket contact 122 is spring biased against the power pad 150 to insure electrical connection between the socket contact 122 and the power pad 150.

The socket housing 120 has an interior surface 160 and an exterior surface 162 facing away from the heat sink 106. The interior surface 160 is mounted to the front 130 of the heat sink 106. The interior surface 160 may be generally planar and define an interface along the front 130 of the heat sink 106. In an exemplary embodiment, the socket housing 120 includes a receptacle 164 that receives the lighting package 102. The receptacle 164 is open along the interior surface 160 such that the lighting package 102 may be seated upon the front 130 of the heat sink 106. The receptacle 164 is sized and shaped to receive the lighting package 102. The receptacle 164 may be used to position the lighting package 102 with respect to the socket housing 120. The lighting package 102 may be held in the receptacle 164 by an interference fit.

In an exemplary embodiment, the socket housing 120 includes an extension 166 extending downward from the interior surface 160. The extension 166 extends generally perpendicular with respect to the interior surface 160 and away from (e.g. further interior) the interior surface 160. The extension 166 is received in the corresponding opening 134 through the heat sink 106. The extension 166 extends at least partially through the heat sink 106. In an exemplary embodiment, the extension 166 extends entirely through the heat sink 106 such that a portion of the extension 166 extends beyond the rear 132 of the heat sink 106. A cavity 168 extends through the extension 166 along a cavity axis 170. The socket contact 122 is received in the cavity 168 and extends along the cavity axis 170.

The socket housing 120 and socket contacts 122 press the lighting package 102 against the heat sink 106 in a pressing direction 154. In an exemplary embodiment, the pressing direction 154 is generally perpendicular to the interior surface 160 of the socket housing 120. The pressing direction 154 may be generally parallel to the cavity axis 170.

The cavity 168 includes a loading end 172 at a distal end of the extension 166. The cavity 168 is open at the loading end 172. The loading end 172 is configured to receive the corresponding power conductor 110 (shown in FIG. 1) along a mating direction 174. The cavity 168 may be formed to direct the power conductor 110 into mating engagement with the socket contact 122. For example, the cavity 168 may have angled or chamfered surfaces that direct the power conductor 110 into alignment with the socket contact 122. The extension 166 surrounds the socket contact 122 such that the extension 166 is positioned between the socket contact 122 and the heat sink 106. The extension 166 provides insulation between the socket contact 122 and the heat sink 106, such as to prevent shorting.

The socket contact 122 extends between a package mating end 180 and a power termination end 182. The package mating end 180 engages the power pad 150 of the lighting package 102 at the separable mating interface 152. The power termination end 182 engages the power conductor 110 when the power conductor 110 is mated to the socket assembly 104. The socket contact 122 creates an electrical path between the power conductor 110 and the power pad 150 of the lighting package 102 to supply power to the lighting package 102.

In an exemplary embodiment, the power termination end 182 extends transverse to the package mating end 180. For example, the power termination end 182 may be approximately perpendicular to the package mating end 180. The package mating end 180 may extend generally parallel to the interior surface 160 and/or the exterior surface 162. The package mating end 180 is generally in plane with the socket housing 120. The power termination end 182 is generally received within the extension 166 and extends at least partially through the cavity 168. The power termination end 182 extends generally parallel to the cavity axis 170.

In the illustrated embodiment, the socket contact 122 is a right-angle contact having the power termination end 182 at approximately 90 degrees with respect to the package mating end 180. In the illustrated embodiment, the socket contact 122 is loaded into the socket housing 120 through the exterior surface 162, however the socket contact 122 may be loaded into the socket housing 120 in other ways, such as through the extension 166 or through a side of the socket housing 120. In the illustrated embodiment, the socket contacts 122 are exposed through the exterior surface, however the socket housing 120 may cover the socket contacts 122 in alternative embodiments.

In the illustrated embodiment, the package mating end 180 includes a spring beam that extends across the exterior surface 162 to engage the lighting package 102. The spring beam is deflectable and is spring biased against the lighting package 102 when the socket assembly 104 is mounted to the heat sink 106. In the illustrated embodiment, the power termination end 182 defines a poke-in wire termination for receiving an exposed portion of the power conductor 110. The power conductor 110 is loaded through the loading end 172 and is poked into the power termination end 182 to terminate the socket contact 122 to the power conductor 110.

The power termination end 182 has a barrel 184 that is open ended to receive the power conductor 110. The power termination end 182 has a lance or beam 186 that extends into the barrel 184 to engage the power conductor 110. The beam 186 is angled to engage the power conductor 110 to resist removal of the power conductor 110 from the power termination end 182 once loaded therein. Other types of terminations may be used in alternative embodiments depending on the type of power conductor 110.

Figure 5:
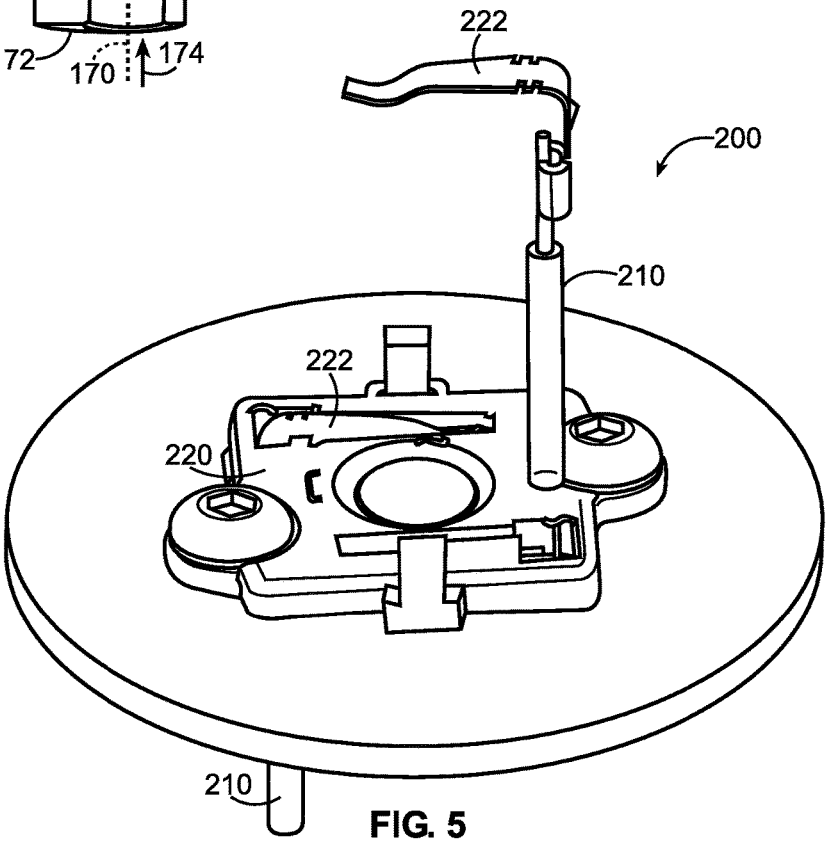
FIG. 5 is a top perspective view of a lighting assembly formed in accordance with an exemplary embodiment.

FIG. 5 is a top perspective view of a lighting assembly 200. The lighting assembly 200 is similar to the lighting assembly 100, however, the lighting assembly 200 includes socket contacts 222 that are terminated to corresponding power conductors 210 by crimp connections. The socket contacts 222 may be crimped to the ends of the power conductor 210 and then the power conductors 210 and socket contacts 222 are loaded into a socket housing 220 from above.

Figure 6:
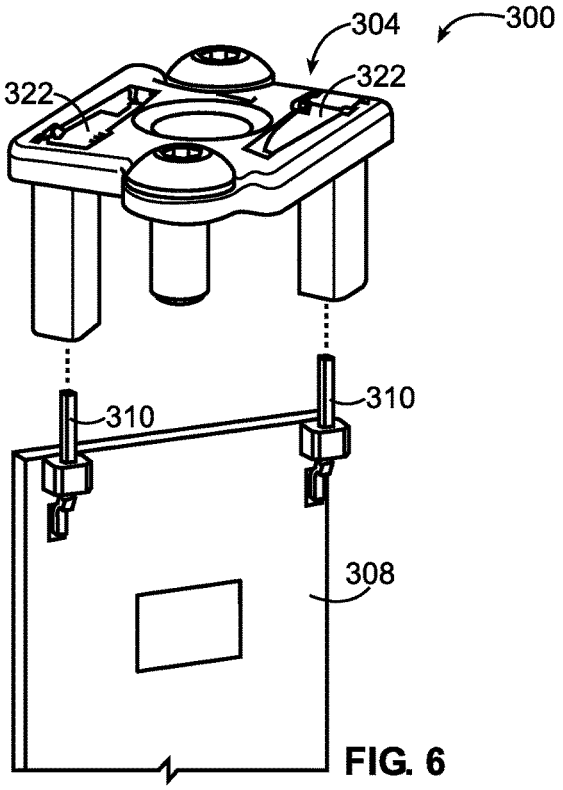
FIG. 6 illustrates a lighting assembly formed in accordance with an exemplary embodiment.

FIG. 6 illustrates a lighting assembly 300 formed in accordance with an exemplary embodiment. The lighting assembly 300 is similar to the lighting assembly 100, however, the lighting assembly 300 includes a driver board 308 having power conductors 310 mounted directly to the driver board 308 that are plugged into a socket assembly 304, which may be substantially similar to the socket assembly 104. The power conductors 310 are contacts, such as pins, soldered to the driver board 308. The power conductors 310 may be plugged directly into poke-in type socket contacts 322 or other types of socket contacts.

Figure 7:
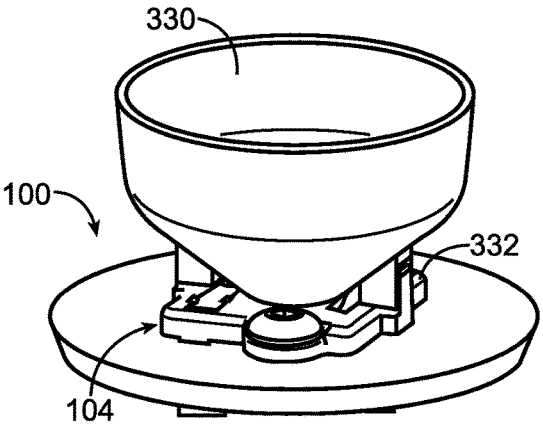
FIG. 7 illustrates the lighting assembly shown in FIG. 1 with an optic component mounted thereto.

FIG. 7 illustrates the lighting assembly 100 with an optic component 330, such as a lens, mounted to the socket assembly 104. The socket assembly 104 includes latches 332 for securing the optic component 330 above the lighting package 102 (shown in FIG. 1).

Figure 8:
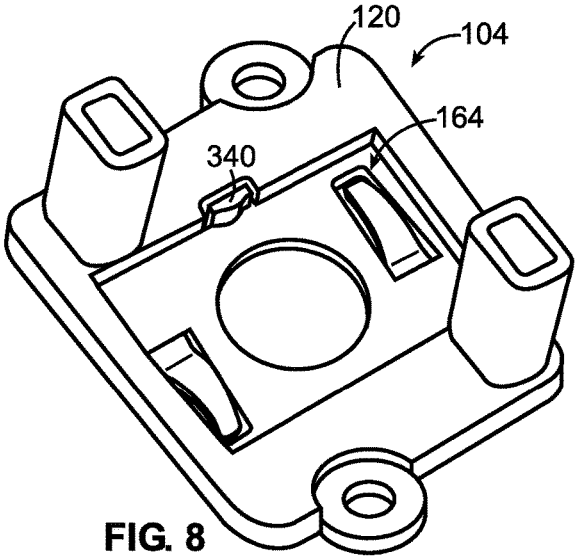
FIG. 8 is a bottom perspective view of a portion of the socket assembly shown in FIG. 1.

FIG. 8 is a bottom perspective view of a portion of the socket assembly 104. FIG. 8 illustrates the receptacle 164 that receives the lighting package 102 (shown in FIG. 1). The socket housing 120 has a finger 340 that extends into the receptacle 164. The finger 340 is deflectable and provides a biasing force against the lighting package 102. The lighting package 102 may be held in the receptacle 164 by an interference fit.

Figure 9:
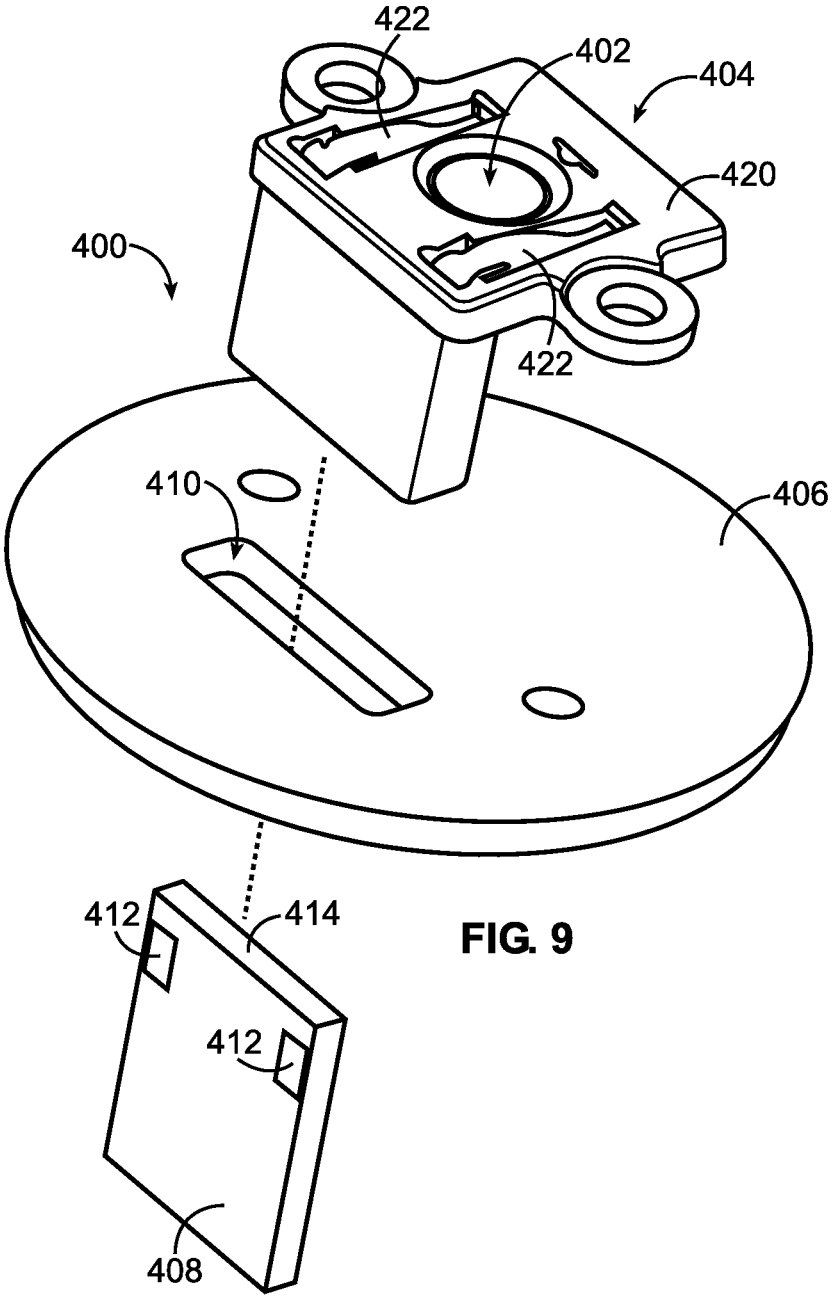
FIG. 9 is an exploded view of a lighting assembly formed in accordance with an exemplary embodiment.

FIG. 9 is an exploded view of a lighting assembly 400 formed in accordance with an exemplary embodiment. The lighting assembly 400 is similar to the lighting assembly 100, however, the lighting assembly 400 defines a card edge connector that directly receives a driver board 408. The lighting assembly 400 includes a solid-state lighting package 402 that is used to generate light. The lighting assembly 400 includes a socket assembly 404 used to hold and power the lighting package 402.

The lighting assembly 400 includes a heat sink 406, or other mounting structure, supporting the socket assembly 404 and the lighting package 402. The heat sink 406 dissipates heat from the lighting package 402 to extend the useful life of the lighting package 402 and prevent damage to the lighting package 402. The heat sink includes an opening 410 therethrough that receives a portion of the socket assembly 404.

The driver board 408 may be a printed circuit board. The driver board 408 includes power conductors 412, such as power pads. The power conductors are positioned near an edge 414 of the driver board 408. The edge 414 is configured to be plugged into the socket assembly 404.

The socket assembly 404 includes a socket housing 420 holding a pair of socket contacts 422. Any number of socket contacts 422 may be used depending on the particular application and the power and control needs. The socket contacts 422 engage the lighting package 402 at a separable interface to supply power to the lighting package 402. The socket contacts 422 are configured to be directly electrically coupled to the power conductors 412 of the driver board 408 when the edge 414 is loaded into the socket housing 420. In an exemplary embodiment, the socket contacts 422 extend through the opening 410.

Figure 10:
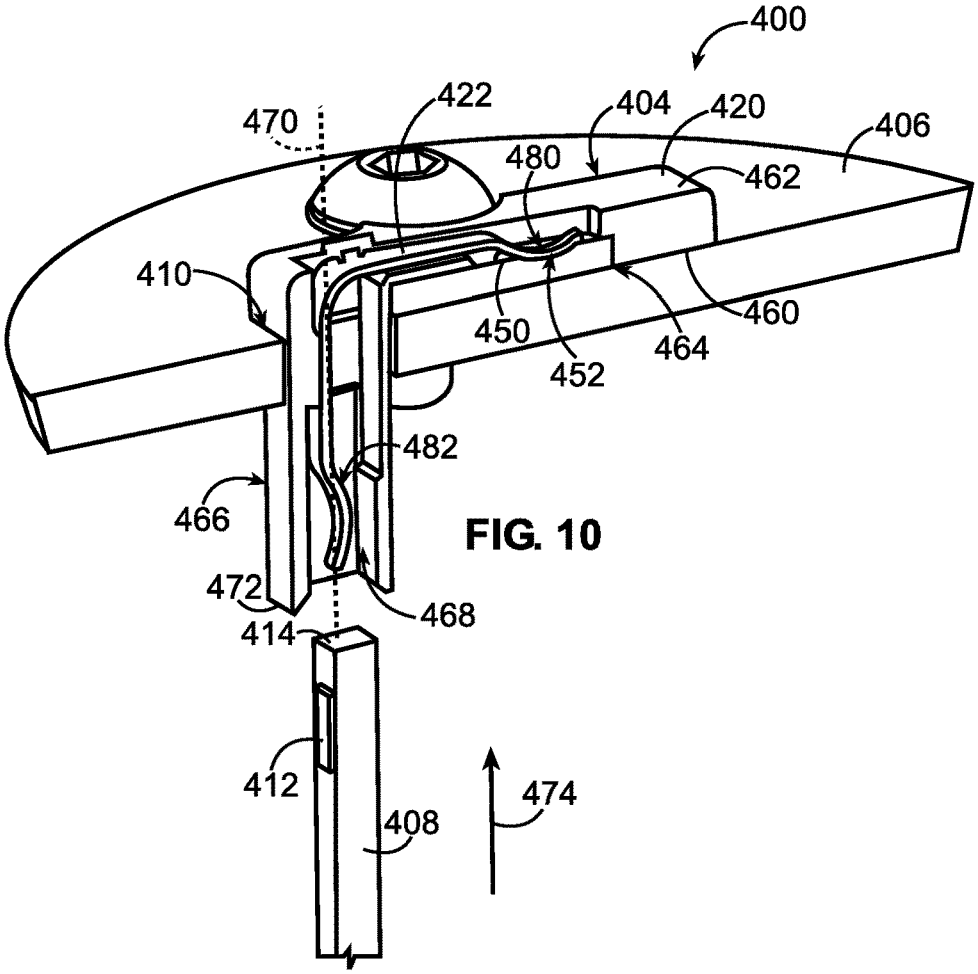
FIG. 10 is a cross sectional view of the lighting assembly shown in FIG. 9.

FIG. 10 is a cross sectional view of the lighting assembly 400. The socket assembly 404 is coupled to the heat sink 406. FIG. 10 illustrates the lighting package 402 in thermal communication with the heat sink 406 and held in place by the socket assembly 404. The lighting package 402 includes a power pad 450 on a surface of the lighting package 402 that is configured to supply power to the LED or other lighting device of the lighting package 402. The power pad 450 is engaged by the socket contact 422 at a separable mating interface 452. The socket contact 422 is spring biased against the power pad 450 to insure electrical connection between the socket contact 422 and the power pad 450.

The socket housing 420 has an interior surface 460 and an exterior surface 462 facing away from the heat sink 406. The interior surface 460 is mounted to the heat sink 406. The interior surface 460 may be generally planar and define an interface along the heat sink 406.

In an exemplary embodiment, the socket housing 420 includes a receptacle 464 that receives the lighting package 402. The receptacle 464 is open along the interior surface 460 such that the lighting package 402 may be seated upon the heat sink 406. The receptacle 464 is sized and shaped to receive the lighting package 402. The receptacle 464 may be used to position the lighting package 402 with respect to the socket housing 420. The lighting package 402 may be held in the receptacle 464 by an interference fit.

In an exemplary embodiment, the socket housing 420 includes an extension 466 extending downward from the interior surface 460. The extension 466 extends generally perpendicular with respect to the interior surface 460 and away from (e.g. further interior) the interior surface 460. The extension 466 is received in the corresponding opening 410 through the heat sink 406. The extension 466 extends at least partially through the heat sink 406. In an exemplary embodiment, the extension 466 extends entirely through the heat sink 406 such that a portion of the extension 466 extends beyond the heat sink 406.

A cavity 468 extends through the extension 466 along a cavity axis 470. The socket contact 422 is received in the cavity 468 and extends along the cavity axis 470. The cavity 468 includes a loading end 472 at a distal end of the extension 466. The cavity 468 is open at the loading end 472. The loading end 472 is configured to receive the edge 414 of the driver board 408 along a mating direction 474.

The socket contact 422 extends between a package mating end 480 and a power termination end 482. The package mating end 480 engages the power pad 450 of the lighting package 402 at the separable mating interface 452. The power termination end 482 engages the power conductor 412 when the edge 414 of the driver board 408 is loaded into the extension 466. The socket contact 422 creates an electrical path between the power conductor 412 and the power pad 450 of the lighting package 402 to supply power to the lighting package 402.

In an exemplary embodiment, the power termination end 482 extends transverse to the package mating end 480. For example, the power termination end 482 may be approximately perpendicular to the package mating end 480. The package mating end 480 may extend generally parallel to the interior surface 460 and/or the exterior surface 462. The package mating end 480 is generally in plane with the socket housing 420. The power termination end 482 is generally received within the extension 466 and extends at least partially through the cavity 468. The power termination end 482 extends generally parallel to the cavity axis 470.

In the illustrated embodiment, the socket contact 422 is a right-angle contact having the power termination end 482 at approximately 90 degrees with respect to the package mating end 480. In the illustrated embodiment, the package mating end 480 includes a spring beam that extends across the exterior surface 462 to engage the lighting package 402. The spring beam is deflectable and is spring biased against the lighting package 402 when the socket assembly 404 is mounted to the heat sink 406. In the illustrated embodiment, the power termination end 482 includes a spring beam that extends into the cavity 468 to engage the driver board 408 when loaded therein. The spring beam is deflectable and is spring biased against the power conductor 412 when the driver board 408 is loaded in the cavity 468.

Figure 11:
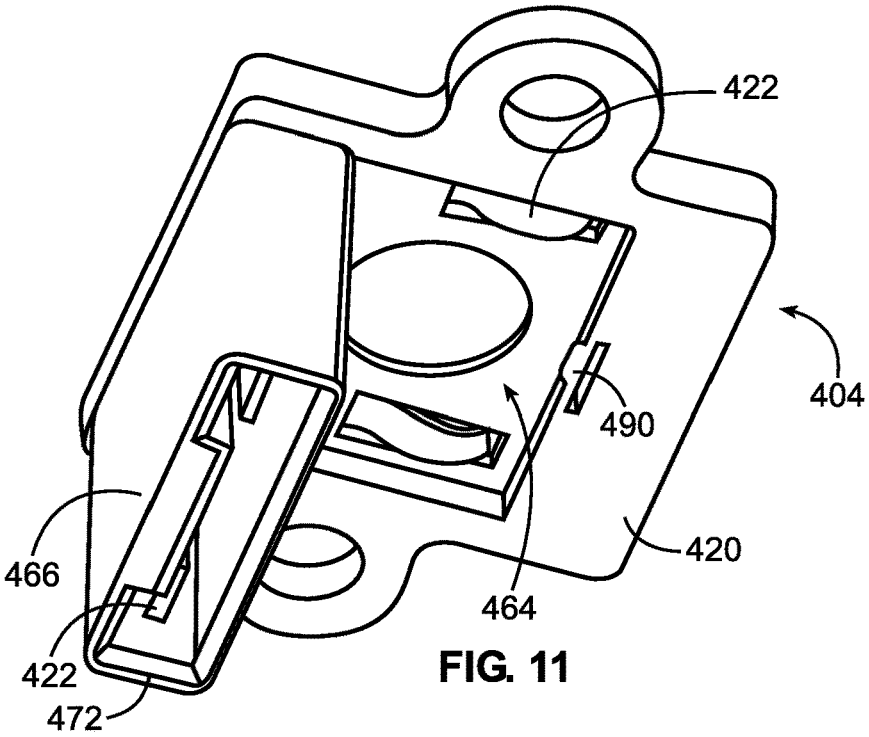
FIG. 11 is a bottom perspective view of a socket assembly for the lighting assembly shown in FIG. 9.

FIG. 11 is a bottom perspective view of the socket assembly 404. FIG. 11 illustrates the receptacle 464 that receives the lighting package 402 (shown in FIG. 9). The socket housing 420 has a finger 490 that extends into the receptacle 464. The finger 490 is deflectable and provides a biasing force against the lighting package 402. The lighting package 402 may be held in the receptacle 464 by an interference fit.

The extension 466 extends from the main portion of the socket housing 420. The extension 466 may be rectangular in shape. The extension may be off-set from a center of the socket housing 420, such as near a side of the socket housing 420. The extension 466 is contained within an outer perimeter of the socket housing 420 so as to not increase the overall footprint of the socket assembly 404. The loading end 472 is open and defines a card edge connector that receives the edge 414 (shown in FIG. 10) of the driver board 408 (shown in FIG. 10). The socket contacts 422 are exposed within the extension 466.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. § 112, sixth paragraph, unless and until such claim limitations expressly use the phrase "means for" followed by a statement of function void of further structure.

What is claimed is:

1. A solid state lighting assembly comprising:

a heat sink having an exterior defined by a front and a rear, the heat sink having an opening therethrough between the front and the rear; and a socket assembly coupled to the heat sink, the socket assembly comprising:

a socket housing having an interior surface mounted to the front of the heat sink, the socket housing being at the exterior at both the front and the rear of the heat sink, the socket housing having a front forward of the front of the heat sink, the socket housing having an extension extending from the interior surface to a rear, the extension being received in the opening and extending entirely through the heat sink such that a distal end of the extension at the rear is at or beyond the rear of the heat sink, the extension having a cavity therein; and a socket contact removably received within the socket housing and held by the socket housing, the socket contact having a package mating end and a power termination end, the power termination end extending into the cavity of the extension such that the power termination end extends at least partially through the heat sink, the power termination end being contained within the cavity and being configured to be terminated to a power conductor received in the cavity, the package mating end being configured to be mechanically and electrically coupled to a solid state lighting package to supply power to a solid state lighting device of the solid state lighting package.

2. The lighting assembly of claim 1, wherein the extension extends generally perpendicular with respect to the interior surface along a cavity axis, the power termination end extending within the cavity generally along the cavity axis.

3. The lighting assembly of claim 1, wherein the socket contact is mated to the power conductor along a mating direction generally perpendicular to the interior surface.

4. The lighting assembly of claim 1, wherein the package mating end and the power termination end are oriented generally perpendicular with respect to one another.

5. The lighting assembly of claim 1, wherein the socket assembly presses the solid state lighting package against the front of the heat sink in a pressing direction, the power termination end extending generally parallel to the pressing direction.

6. The lighting assembly of claim 1, wherein the cavity is cylindrical in shape to receive the power conductor, the power conductor being one of an end of a wire or a pin.

7. The lighting assembly of claim 1, wherein the cavity defines a card edge slot configured to receive an edge of a driver board, the driver board having a power pad defining the power conductor, the power termination end mechanically and electrically engaging the power pad on the driver board.

8. The lighting assembly of claim 1, wherein the power termination end defines a poke-in wire termination having a deflectable beam engaging an end of a wire poked into the cavity and defining the power conductor.

9. The lighting assembly of claim 1, wherein the power termination end defines a crimped termination engaging an end of a wire defining the power conductor.

10. The lighting assembly of claim 1, wherein the socket housing includes a second extension extending from the interior surface defining a second cavity, the socket assembly comprising a second socket contact received in the second cavity.

11. A solid state lighting assembly comprising:

a heat sink defined by an exterior having a front and a rear, the heat sink having an opening therethrough between the front and the rear;

a socket housing having an interior surface mounted to the front of the heat sink and an exterior surface, the socket housing being at the exterior at both the front and the rear of the heat sink, the socket housing having an extension extending from the interior surface, the extension being received in the opening and extending entirely through the heat sink such that a distal end of the extension is at or beyond the rear of the heat sink, the extension having a cavity therein, the socket housing having an opening therethrough between the interior surface and the exterior surface, the interior surface being configured to be mounted to a heat sink, the socket housing having a receptacle open at the interior surface;

a solid state lighting package received in the receptacle, the solid state lighting package having a lighting device aligned with the opening and configured to emit light, the solid state lighting package having a power pad configured to supply power to the lighting device; and a socket contact held by the socket housing, the socket contact having a package mating end engaging the power pad of the solid state lighting package at a separable mating interface, the socket contact having a power termination end extending transverse to the package mating end, the power termination end having a wire barrel terminated to an end of a wire defining a power conductor for supplying power to the solid state lighting package, the wire barrel and wire extending generally perpendicular to the interior surface of the socket housing.

12. A solid state lighting assembly comprising:

a heat sink defined by an exterior having a front and a rear, the heat sink having an opening therethrough between the front and the rear;

a socket housing having an interior surface mounted to the front of the heat sink and an exterior surface, the socket housing being at the exterior at both the front and the rear of the heat sink, the socket housing having an extension extending from the interior surface, the extension being received in the opening and extending entirely through the heat sink such that a distal end of the extension is at or beyond the rear of the heat sink, the extension having a cavity therein, the socket housing having an opening therethrough between the interior surface and the exterior surface, the interior surface being configured to be mounted to a heat sink, the socket housing having a cavity defining a card edge slot configured to receive an edge of a driver board;

a socket contact removably received within the socket housing and held by the socket housing, the socket contact having a package mating end and a power termination end, the power termination end extending into the cavity, the power termination end being configured to engage power conductors on the driver board when the driver board is received in the cavity, the package mating end being configured to be mechanically and electrically coupled to a solid state lighting package to supply power to a solid state lighting device of the solid state lighting package.

13. The lighting assembly of claim 12, further comprising a driver board having an edge and power conductors proximate to the edge, the driver board being loaded into the cavity of the socket housing.

14. The lighting assembly of claim 12, wherein the cavity extending through the extension, the power termination end of the socket contact being positioned in the cavity in the extension, the extension configured to receive the edge of the driver board.

15. The lighting assembly of claim 12, wherein the cavity receives the driver board along a mating direction generally perpendicular to the interior surface, the socket contact being directly mated to the power conductor of the driver board as the driver board is loaded into the cavity along the mating direction.

16. The lighting assembly of claim 11, wherein the power termination end defines a poke-in wire termination having a deflectable beam engaging an end of the wire poked into the socket housing in a mating direction generally perpendicular to the interior surface.

17. The lighting assembly of claim 11, wherein the power termination end defines a crimped termination engaging an end of the wire defining the power conductor.

* * * * *